United States Patent [19]

Kondo

[11] 4,240,185

[45] Dec. 23, 1980

[54] METHOD FOR FULLING FABRIC

[75] Inventor: Shigeki Kondo, Inagi, Japan

[73] Assignee: Tokyo Juki Kogyo Kabushiki Kaisha, Chofu, Japan

[21] Appl. No.: 966,754

[22] Filed: Dec. 5, 1978

Related U.S. Application Data

[63] Continuation of Ser. No. 779,832, Mar. 21, 1977, abandoned.

[30] Foreign Application Priority Data

Mar. 24, 1976 [JP] Japan ..... 51-33026

[51] Int. Cl.[3] ..... D06C 17/00

[52] U.S. Cl. ..... 26/19

[58] Field of Search ..... 26/1, 18.5, 19; 8/149.3

[56] References Cited

U.S. PATENT DOCUMENTS

| | | | |
|---|---|---|---|
| 1,967,130 | 7/1934 | Nuernberg | 26/1 X |
| 2,144,934 | 1/1939 | Riggs | 26/19 |
| 2,338,386 | 1/1944 | Strake | 26/19 |
| 2,773,295 | 12/1956 | Glassford et al. | 26/18.5 |
| 3,006,055 | 10/1961 | Chapin | 26/19 |
| 3,061,905 | 11/1962 | Schiffers et al. | 26/19 |
| 3,965,511 | 6/1976 | Fleissner | 8/149.3 X |

FOREIGN PATENT DOCUMENTS

| | | | |
|---|---|---|---|
| 972940 | 8/1975 | Canada | 26/18.5 |
| 1315806 | 12/1962 | France | 26/1 |
| 678585 | 9/1952 | United Kingdom | 26/1 |
| 1129204 | 10/1968 | United Kingdom | 26/18.5 |

OTHER PUBLICATIONS

Hunter, James H., The Use of Superheated Steam as a Drying Medium, American Dyestuff Reporter, pp. 236–238, Apr. 12, 1954.

*Primary Examiner*—Robert Mackey

*Attorney, Agent, or Firm*—Wenderoth, Lind & Ponack

[57] ABSTRACT

A knitted or woven fabric in the form of a pliable sheet in fulled by having the fabric be conveyed in one direction, cooled to a temperature below the freezing point of water, impregnated with moisture and dried.

11 Claims, 1 Drawing Figure

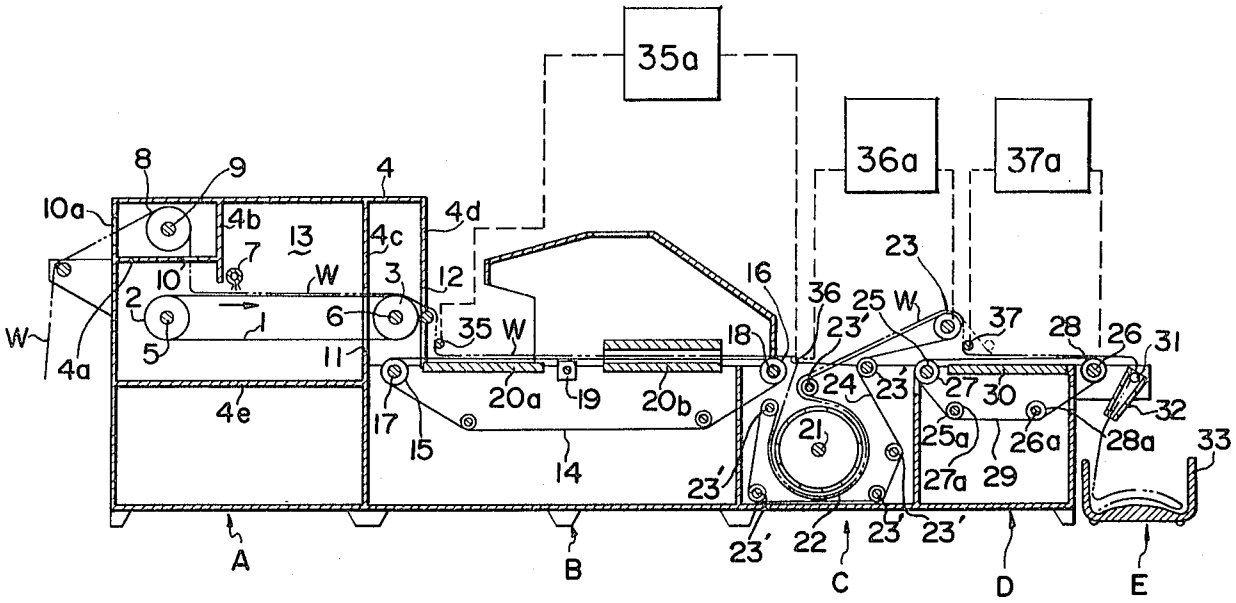
35a
36a
37a
A
B
C
D
E
W

METHOD FOR FULLING FABRIC

This is a continuation of application Ser. No. 779,832, filed Mar. 21, 1977, now abandoned.

BACKGROUND OF THE INVENTION

This invention relates to a method for fulling a knitted or woven fabric and an apparatus for carrying out the method, and more particularly, to a method for fulling knitted or woven fabrics capable of being fulled and particularly, fabrics of wool or blended wool wherein the fabric is first cooled to a temperature below the freezing point, impregnated with moisture so as to cause the moisture to permeate into and adhere to the fabric and dried to a desired moisture content whereby any strain which might otherwise be potentially present in the fabric when the fabric is woven and/or finished can be eliminated, and an apparatus for carrying out the method.

As compared with fabrics knitted or woven from synthetic fiber or from synthetic fiber blended with natural fiber other than wool fiber, knitted or woven fabrics, particularly containing wool, have been found to have the disadvantage that the diameter of the fibers of the fabrics increases upon absorbing an excess amount of moisture this leading to an increase in the rate of bending of the yarns formed of such fibers and resulting in an increase in the dimensions of the fabrics, that when the moisture is evaporated from the fabrics in the reverse way, the rate of bending of the yarns decreases and the dimensions of the fabrics diminish, and that since an internal strain remains potentially within the fabrics due to an external force which acts on the fabrics when the fabrics are woven, unwound and/or wound, the fabrics experience gradual deformation resulting in variation in the dimensions of the fabrics as time goes by. In order to eliminate variation in the dimensions of the fabrics, it has been commonly practiced that the fabrics are immersed into warm water or steam or that heated steam is jetted thereagainst and then dried after any excess moisture has been evaporated therefrom. However, such a conventional method can not fully eliminate potential internal strain from the fabrics. Thus, after the thus treated fabrics have been cut into pieces having predetermined shapes and dimensions or such fabric pieces have been sewn together and pressed, the cut and/or sewn fabric pieces tend to gradually vary in dimensins and the garment loses its shape.

SUMMARY OF THE INVENTION

Therefore, the object of the present invention is to eliminate the disadvantages of the conventional art by removing completely the potential internal strain from fabric.

According to the present invention, a knitted or woven fabric to be fulled is initially cooled to a temperature below 0° C. to freeze the moisture on the surface of and between the fibers of the fabric. The cooling of the fabric is preferably effected in such a manner that the surface temperature of the fabric is reduced to a temperature below 0° C. and preferably within the range from 0° C. to −20° C. with the most preferred temperature being about −8° C. The cooling of the fabric is effected by directly jetting steam against the fabric, then passing the fabric through a refrigeration chamber, or by combining a direct spray and refrigeration. Generally, the cooling of the fabric is effected by directly spraying a liquid coolant against the surface of the knitted or woven fabric while the fabric is passing through a refrigeration chamber having openings just sufficient to pass the fabric therethrough. The liquid coolants which can be suitably employed in the present invention include liquefied nitrogen, helium, hydrogen, oxygen, carbon dixoide, ammonia and the like. The temperature of the refrigeration chamber decreases due to the sprayed coolant, but the temperature of the atmosphere within the refrigeration chamber is preferably maintained within the range of from −30° C. to −60° C. When cooled, the volume of the fabric increases due to the freezing of the moisture thereon and therein to expand the openings between the fibers of the fabric to provide such a fabric state that the given moisture can be easily absorbed in and adsorbed to the fabric. Then, moisture is applied to the cooled fabric, for example, by jetting heated steam against the fabric. If the fabric is oscillated while the moisture is being applied thereto, the fulling effect will be further enhanced. Thereafter, the knitted or woven fabric is dried by means of any conventional drying means. Although any conventional drying means can be employed, a high temperature steam jet is more advantageous since the steam jet concurrently dries the fabric and eliminates any internal strain within the fabric.

The above and other objects and attendant advantages of the present invention will be more readily apparent to those skilled in the art from a reading of the following detailed description in conjunction with the accompanying drawing which shows one preferred embodiment of the invention for illustration purposes only, but not for limiting the scope of the same in any way.

BRIEF DESCRIPTION OF THE DRAWING

The sole FIGURE of the accompanying drawing is a longitudinal sectional view of a knitted or woven fabric fulling apparatus constructed in accordance with the present invention and by which the method of the invention is successfully practiced.

DETAILED DESCRIPTION OF THE PREFERRED EMBODIMENT

The present invention will now be described referring to the accompanying drawing in which the preferred embodiment of the invention is shown for illustration purpose only, but not for limiting the scope of the same in any way. As seen, going from the left-hand side to the right-hand side in the sole FIGURE of the drawing, the knitted or woven fabric fulling apparatus of the invention generally comprises a first station A, a second station B, a third station C, a fourth station D and a fifth station E which are arranged in the above-enumerated order along the passage of an unwound piece of knitted or woven fabric W to be processed by the method of the invention and in which various processes are performed on the fabric.

In the first station A, a pair of spaced and parallel shafts 5, 6 are rotatably supported in the machine frame 4 of the apparatus by suitable means such as bearings (not shown) and pulleys 2 and 3 are fixedly secured to the rotary shafts 5, 6, respectively. An endless belt 1 having a relatively wide width is trained about the pulleys 2, 3. Cooling means is provided above the upper run of the endless belt 1 and comprises a plurality of spray nozzles 7 above the upper run of the belt 1 (only one nozzle 7 is shown) arranged in the direction of the width of the fabric W or in a direction transversely of the feeding direction of the fabric (in the direction of the arrow) for uniformly spraying a liquid coolant supplied from a suitable liquid coolant supply source (not shown) such as liquefied nitrogen, helium, hydrogen, oxygen, carbon dioxide or ammonia toward the upper surface of the upper run of the endless belt 1. The first station A further includes a horizontal partition wall 4*a* extending horizontally from the left-hand end of the machine frame 4 into the first station A by a certain distance, a vertical partition wall 4*b* extending vertically and downwardly from the top of the machine frame 4 intersecting the horizontal partition wall 4*a* at right angles. The lower end of the partition wall 4*b* extends beyond the horizontal partition wall 4*a* and terminates short of the upper run of the endless belt 1 so as not to interfere with the passage of the belt and fabric. The first station A further includes a second vertical partition wall 4*c* extending the full height of the associated station at a position parallel to and inwardly spaced from the first vertical partition wall 4*b* and a third vertical partition wall 4*d* extending vertically downwardly from the top of the associated station by a distance greater than the extending distance of the first partition wall 4*b* at a position inwardly spaced from the second vertical partition wall 4*c*. A second horizontal partition wall 4*e* is disposed below the lower run of the endless belt 1 and extends the full length of the first station A in a direction parallel to the first horizontal partition wall 4*a*. The first and second horizontal partition walls 4*a*, 4*e* and first and second vertical partition walls 4*b*, 4*c* define a refrigeration chamber 13 in which the shaft and pulley assembly 2 and 5, a substantial portion of the endless belt 1 and the spray nozzles 7 are disposed. The first horizontal partition wall 4*a* and second and third vertical partition walls 4*c*, 4*d* are provided with openings 10, 11 and 12, respectively, through which the endless belt 1 and fabric W to be processed are fed within the first station A (the openings 10 and 12 pass only the fabric W therethrough). A shaft 9 is rotatably supported in the machine frame 4 by suitable means such as bearings (not shown) within a space defined by the first horizontal and vertical partition walls 4*a*, 4*b* and the top of the machine frame 4 and extends in a direction parallel to the shaft 5, and a guide roller 8 having a felt applied about the periphery thereof is fixedly secured to the rotary shaft 9. In operation, the fabric W to be treated is unwound from a suitable fabric supply source (not shown) and fed through an opening 10*a* in the left hand end of the machine frame 4 onto the guide roller 8 from which the fabric W is then fed through the opening 10 in the first horizontal partition wall 4*a* onto the upper run of the moving endless belt 1 which carries the fabric W therewith to the second station B.

In the second station B, a pair of spaced and parallel shafts 17, 18 are rotatably supported in the machine frame 4 by suitable means such as bearings, for example, and pulleys 15, 16 are fixedly secured to the shafts 17, 18, respectively. An endless belt 14 having substantially the same width as the endless belt 1 is trained about the pulleys 15, 16 and oscillation means comprising a rotary member 19 having a rectangular cross-section is fixedly secured to a shaft which is in turn rotatably supported in the machine frame 4 by suitable means such as bearings (not shown) between and spaced from the pulleys 15, 16 for making contact with the lower surface of the upper run of the endless belt 14. First steam jet means 20*a* is suitably provided on the machine frame 4 between the shaft and pulley assembly 17, 15 and rotary member 19 below the lower surface of the upper run of the endless belt 14 to direct vapor at an elevated temperature upwardly against the lower surface of the belt upper run, and similarly, second steam jet means 20*b* is provided on the machine frame 4 between the rotary member 19 and shaft and pulley assembly 18, 16. The second steam jet means 20*b* embraces the upper run of the endless belt 14 from above and below in a spaced relationship thereto so as to direct steam at an elevated temperature against the upper and lower surfaces of the belt upper run.

In the third station C, a shaft 21 is fixedly supported in the machine frame 4 by suitable means such as bearings (not shown) and a cylindrical set roller 22 is mounted on the stationary shaft for rotation about the axis of the shaft. The set roller is adapted to be heated by steam or electrical heating means (not shown). A roller 23 is fixedly supported in the machine frame 4 in a position above the fourth station D by suitable means such as bearings (not shown), and a series of rollers 23' are fixedly supported on their respectively associated shafts which are in turn suitably supported in the machine frame 4 by suitable means such as bearings, for example, in positions radially and outwardly spaced from the periphery of the set roller 22 at different distances therefrom. An endless belt 24 is trained about the set roller 22, single roller 23 and the series of rollers 23'.

In the fourth station D, a pair of spaced and parallel shafts 25, 26 are rotatably supported in the machine frame 4 by suitable means such as bearings (not shown), for example, and pulleys 27 and 28 are fixedly secured to the shafts 25, 26, respectively. Similarly, another set of spaced shafts 25*a*, 26*a* are rotatably supported in the machine frame 4 by suitable means such as bearings (not shown) between the shaft and pulley assemblies 25, 27 and 26, 28, and another set of rollers 27*a*, 28*a* are fixedly supported on the respectively associated shafts 25*a*, 26*a*, respectively. An endless belt 29 is trained about the pulleys 25, 26 and rollers 25*a*, 26*a*, and suction means 30 is provided on the machine frame 4 below the lower surface of the upper run of the endless belt 29 so as to draw air downwardly through the fabric W.

In the fifth station E, a shaft 31 is rotatably supported in the machine frame 4 by suitable means such as bearings (not shown), fabric folding means is suitably provided with its arm 32 fixedly secured to the shaft 31, and a hollow truncated fabric receptacle 33 is provided below the folding means for receiving the processed fabric W in an orderly folded condition therein.

All the shafts referred to hereinabove extend transversely of the apparatus in parallel relationship to each other.

The shafts of the above-mentioned pulleys 3, 16 and 28 and rollers 8 and 23 and rotary member 19 are adapted to be rotated in the clockwise direction by their respectively associated drive motors (not shown) and the shaft 31 of the folding means is interlocked with the drive motor for the shaft 26 of the pulley 28 so as to rock in synchronization with the rotational movement of the endless belt 29. The set roller 22 is interlocked with the drive motor for the shaft of the pulley 23 and rotated in the counterclockwise direction at the same peripheral speed as the endless belt 24. Reference numerals 35, 36 and 37 denote fabric tension detection levers which are adapted to normally make contact with the fabric W being transported through the successive processing stations to detect the ever varying tension on the fabric W while the fabric is being transported within the apparatus. The fabric tension detection levers 35, 36 and 37 are each displaced in response to any variation in the tension of the fabric W being transported and control, via control units 35*a*, 36*a* and 37*a*, respectively, the output voltage of associated drive motors in proportion to the displacement, to thereby vary the speed of movement of the associated endless belts 14, 24 or 29. For example, when the fabric tension detection lever 35 is displaced in response to an increase in the tension of the fabric W, the detection lever controls, via unit 35*a*, the output voltage of the drive motor associated therewith to thereby reduce the speed of movement of the endless belt 14 downstream of the detection means 35 in the direction of feeding of the fabric W.

The operation of the fabric fulling apparatus of the invention having the above-mentioned construction and arrangement of the parts thereof will be now described hereinbelow.

When the fulling apparatus is started from its condition as shown in the drawing the knitted or woven fabric W is unwound from the supply source (not shown) into the fulling apparatus and then fed on the endless belts 1, 14, 24 and 29 through the successive stations A, B, C, D and E in order or from the left-hand side to the right-hand side as seen in the FIGURE. While the fulling treatment on the fabric is being performed by the method of the present invention, when the fabric W shrinks in the width direction to increase the tension of the fabric W in the treating zone between the endless belts 24, 29, for example, the fabric W displaces from the two-dot-chain line position to the dotted line position as seen in the FIGURE, and as a result, the fabric tension detection lever 37 is displaced from the full line position to the dotted line position as seen in the FIGURE in response to the displacement of the fabric as mentined above, and the displacement of the detection lever 37 reduces the speed of movement of the endless belt 29 and accordingly, the rotational speed of the drive motor associated with the belt 29 through control unit 37*a* until the tension of the fabric W in the zone between the endless belts 24, 29 decreases to a predetermined or desired value and the displaced tension detection lever 37 returns to the initial full line position.

Now, the manner in which the internal strain in the fabric W is eliminated by the fulling apparatus of the invention will be described. While the knitted or woven fabric W is fed into the first station A by the roller 8 to move on the endless belt 1 within the refrigeration chamber 13, the nozzles 7 are operated to have the nozzles spray coolant against the upper surface of the moving fabric W to rapidly freeze the moisture present on the surface and between the fibers of the fabric, and the freezing of the moisture increases the volume thereof to expand the openings between the fibers and at the same time, reduces the temperature on the surface of the fabric to put the fabric in such a condition that moisture is easily absorbed by and sticks to the fabric when moisture is applied to the fabric later. At this time, if the moving speed of the first endless belt 1 is reduced or the amount of the coolant in the jets from the nozzles 7 is increased, the temperature of the fabric W is reduced to the temperature of the coolant itself while the fabric W is passing through the refrigeration chamber 13. When the liquid coolant is nitrogen, its temperature is about −196° C., oxygen coolant is about −183° C., hydrogen is about −253° C., carbon dioxide is about −78° C. and ammonia is about −33° C., but the temperature of the atmosphere within the refrigeration chamber 13 is preferably maintained within the range from −30° C. to −60° C. When the temperature within the refrigeration chamber 13 is maintained at about −45° C., the moisture within and without the fabric W momentarily freezes when the fabric W enters the refrigeration chamber 13 and immediately after the fabric W has cleared the refrigeration chamber 13, the temperature of the surface of the fabric W increases to about −8° C. For this reason, as the difference between the temperature of the surface of the fabric W and the surrounding atmosphere increases, the hygroscopic property of the fabric W becomes proportionally greater but when the fabric W itself is cooled to and below about −100° C., the fibers of the fabric W become fragile. And even if the fabric W absorbs any excess amount of moisture, the fulling effect on the fabric W will not be improved beyond a certain limit, and the fabric W having such an excess amount of moisture requires a relatively long time and a great deal of energy for drying which is performed on the fabric in the later stage of the fulling treatment thereof. Thus, the fabric W preferably has a surface temperature of about −8° C. immediately after the fabric W has cleared chamber 13.

After the moisture freezing step, the fabric W is then fed to the second station B. In this second station B, as the rotary member 19 rotates, the second endless belt 14 is oscillated upwardly and downwardly to throw the fabric W up into the air to thereby render the fabric W tensionless. While the endless belt 14 is oscillated upwardly and downwardly as mentioned above, the first steam jet means 20*a* may be operated to jet vapor at a temperature of from 80° to 100° C., and preferably about 90° C. for 3–20 seconds against the lower surface of the belt 14 to cause the fabric W to fully absorb the moisture within and without thereof. After the thus treated fabric W has cleared the steam jet means 20*a* and rotary member 19, the fabric W may pass through the second steam jet means 20*b* which sprays a jet of steam at a higher temperature of from 100° to 180° C., and preferably about 180° C. for 3–20 seconds against the upper surface of the fabric W and the lower surface of the upper run of the endless belt 14 to expell some of the moisture absorbed in and sticking to the fabric W in the form of vapor to have the fabric W contain a proper amount of moisture. That is, at the stage of the first steam jet means 20*a*, the fabric W contains a sufficient amount of moisture absorbed therein and adhering thereto and is in its tensionless state, and at the succeeding second steam jet means 20*b*, any strain within the fabric W is removed by the heat of the high temperature steam and at the same time, any excess moisture is removed or expelled from the fabric to give a proper moisture content to the fabric W. After the thus treated fabric W has cleared the second station B, the fabric proceeds to the third station C in which as the fabric W moves on the third endless belt 24 about the set roller 22, the fabric W is set by the heat from the set roller and the set fabric W is then fed to the fourth station D in which the suction means 30 draws outer air through the fabric W to cool the fabric W. The thus treated fabric W is then fed to the fifth station E in which the fabric W is folded in alternately opposite directions by means of the folding means and stacked in the receptacle 33.

As is clear from the foregoing description of the preferred embodiment of the invention, according to the present invention, since the knitted or woven fabric W is cooled and steam is applied thereto in its tensionless state to cause moisture to adhere to the surface of and to be absorbed within the structure of the fabric, the fabric is fully relaxed and no strain is present in the fabric W. Therefore, even after the thus treated fabric W has been cut into fabric pieces having a desired size or the cut fabric pieces have been sewn together, there is no possibility of change in size of the cut fabric pieces or of occurrence of any distortion (puckering) in the sewn portion of the fabric pieces. Thus, by the use of the fabric fulled in accordance with the present invention, fabric products of high commercial value which will keep their shape even after long use can be obtained.

While only one embodiment of the invention has been shown and described in detail, it will be understood that the same is for illustration purposes only and not to be taken as a definition of the invention, reference being had for this purpose to the appended claims.

What I claim is:

1. A method for fulling a wool-containing fabric in the form of a pliable sheet, said method comprising the steps of:

conveying said fabric sheet sequentially in order through a cooling station, a moisture applying station, and a drying station;

within said cooling station cooling said fabric sheet to a temperature below the freezing point of water and thereby expanding the spaces between the fibers of said fabric sheet;

at said moisture applying station, applying moisture to the thus cooled fabric sheet by subjecting said fabric sheet to first jets of steam at a maximum temperature of 100° C., thereby causing said fabric sheet to absorb said moisture, and thereafter subjecting said fabric sheet to second jets of steam at a mimimum temperature of 100° C., said second jets of steam being at a higher temperature than said first jets of steam, thereby removing excess moisture from said fabric sheet and making the distribution of moisture in said fabric sheet uniform;

at said drying station drying said fabric sheet;

detecting varying tension of said fabric sheet at an area between said cooling station and said moisture applying station; and controlling the speed of movement of said fabric sheet through said moisture applying station, in response to the amount of tension detected in said detecting step, such that said fabric sheet is maintained substantially tensionless during passage through said moisture applying station and during said steps of subjecting said fabric sheet to said first and second jets of steam.

2. A method as claimed in claim 1, wherein said step of cooling comprised directing a liquid coolant against said fabric sheet.

3. A method as claimed in claim 1, wherein said fabric sheet is cooled to a temperature such that the surface temperature of said fabric sheet is from 0° C. to −20° C.

4. A method as claimed in claim 3, wherein said surface temperature of said fabric sheet is cooled to −8° C.

5. A method as claimed in claim 1, further comprising, between said steps of subjecting said fabric sheet to said first and second jets of steam, oscillating said fabric sheet up and down, and thereby tending to render said fabric sheet tensionless.

6. A method as claimed in claim 1, wherein said first jets of steam are at a temperature of from 80° C. to 100° C.

7. A method as claimed in claim 1, wherein said first jets of steam are at a temperature of approximately 90° C.

8. A method as claimed in claim 1, wherein said second jets of steam are at a temperature of from 100° C. to 180° C.

9. A method as claimed in claim 1, wherein said second jets of steam are at a temperature of approximately 180° C.

10. A method as claimed in claim 1, wherein said first jets of steam are directed against one surface only of said fabric sheet, and said second jets of steam are directed against both opposite surfaces of said fabric sheet.

11. A method as claimed in claim 1, wherein said step of drying comprises passing said fabric sheet around a heat setting roller and thereat applying heat to said fabric sheet, and thereafter subjecting said fabric sheet to vacuum.

* * * * *